US010096254B2

(12) United States Patent
Nauman et al.

(10) Patent No.: US 10,096,254 B2
(45) Date of Patent: Oct. 9, 2018

(54) SYSTEM FOR GUIDING AN AIRCRAFT TO A REFERENCE POINT IN LOW VISIBILITY CONDITIONS

(75) Inventors: Ron Nauman, Biniamina (IL); Ilan Efrat, Haifa (IL); Roee Hartuv, Tel-Aviv (IL); Eyal Halifa, Tel-Aviv (IL); Ofer Klein, Tel Aviv (IL); Hagay Makov, Biniamina (IL); Eran Galed, Kiryat Motzkin (IL)

(73) Assignee: Elbit Systems Ltd., Haifa (IL)

( * ) Notice: Subject to any disclaimer, the term of this patent is extended or adjusted under 35 U.S.C. 154(b) by 90 days.

(21) Appl. No.: 13/582,526

(22) PCT Filed: Mar. 3, 2011

(86) PCT No.: PCT/IB2011/050902
§ 371 (c)(1),
(2), (4) Date: Feb. 12, 2013

(87) PCT Pub. No.: WO2011/107956
PCT Pub. Date: Sep. 9, 2011

(65) Prior Publication Data

US 2013/0138275 A1 May 30, 2013

Related U.S. Application Data

(60) Provisional application No. 61/309,890, filed on Mar. 3, 2010.

(51) Int. Cl.
*G08G 5/00* (2006.01)
*G08G 5/02* (2006.01)

(52) U.S. Cl.
CPC ..... *G08G 5/025* (2013.01); *G08G 5/0021* (2013.01); *G08G 5/0052* (2013.01)

(58) Field of Classification Search
CPC ..... G08G 5/025; G08G 5/0021; G08G 5/0052
See application file for complete search history.

(56) References Cited

U.S. PATENT DOCUMENTS 5,420,582 A 5/1995 Kubbat et al.
7,280,896 B2 * 10/2007 Morizet et al. ..... 701/3
(Continued)

FOREIGN PATENT DOCUMENTS

EP 1603098 12/2005
EP 2136276 12/2009

OTHER PUBLICATIONS

International Search Report issued for the corresponding PCT application No. PCT/IB2011/050902, dated Jul. 18, 2011.
(Continued)

*Primary Examiner* — Mussa A Shaawat
*Assistant Examiner* — Abdhesh K Jha
(74) *Attorney, Agent, or Firm* — Pearl Cohen Zedek Latzer Baratz LLP

(57) ABSTRACT

A method of visually guiding a pilot flying an aircraft using one or more conformal symbols whose position is dynamically updated throughout the guidance is provided herein. The method includes the following stages: determining a desired flight route of an aircraft, based on a user-selected maneuver; presenting to a pilot, on a display, at least one 3D visual symbol that is: (i) earth-space stabilized, and (ii) positioned along a future location along the desired route; computing an updated desired route based on repeatedly updated aircraft flight data that include at least one of: location, speed, and spatial angle, of the aircraft; and repeating the presenting of the at least one 3D visual symbol with its updated location along the updated desired route.

25 Claims, 4 Drawing Sheets

(56) References Cited

U.S. PATENT DOCUMENTS

| | | | | |
|---|---|---|---|---|
| 2003/0195672 | A1 | 10/2003 | He | |
| 2004/0225420 | A1 | 11/2004 | Morizet et al. | |
| 2005/0206533 | A1* | 9/2005 | Rogers et al. | 340/979 |
| 2007/0299611 | A1* | 12/2007 | Winkler | G01C 23/005 701/301 |
| 2010/0168937 | A1* | 7/2010 | Soijer | G08G 5/0052 701/11 |

OTHER PUBLICATIONS

Written Opinion issued for the corresponding PCT application No. PCT/IB2011/050902, dated Jul. 18, 2011.

* cited by examiner

SYSTEM FOR GUIDING AN AIRCRAFT TO A REFERENCE POINT IN LOW VISIBILITY CONDITIONS

BACKGROUND

1. Technical Field

The present invention relates to a visual guiding tool for pilots and more particularly, to such tools that employ conformal symbology.

2. Discussion of the Related Art

Low visibility conditions, usually due to harsh weather or dust, pose a real challenge for pilots in performing various maneuvers such as landing, avoiding obstacles, and following a terrain in low altitude.

Visual guiding tools, for guiding pilots by providing visual reference indicators throughout a specific maneuver are known in the art. One important prerequisite of these tools is that the visual indicators will be conformal with the pilot's view so that he or she may use the visual indicators as references for the actual surrounding.

One notable visual guidance tool is referred to as "virtual pathways in the sky" in which a conformal pathway or series of gates are presented to the pilot. The pathways or the gates serve as points of reference and by following them or passing through them, the maneuver can be carried out safely.

BRIEF SUMMARY

One aspect of the invention provides a method of visually guiding a pilot flying an aircraft using one or more conformal symbols whose position is dynamically updated throughout the guidance. The method includes the following stages: determining a desired flight route of an aircraft, based on a user-selected maneuver; presenting to a pilot, on a display, at least one 3D visual symbol that is: (i) earth-space stabilized, and (ii) positioned along a future location along the desired route; computing an updated desired route based on repeatedly updated aircraft flight data that includes at least one of: location, speed, and spatial angle, of the aircraft; and repeatedly presenting the at least one 3D visual symbol with its updated location along the updated desired route.

Other aspects of the invention may include a system arranged to execute the aforementioned method and a computer readable program configured to execute the stages of the aforementioned method. These, additional, and/or other aspects and/or advantages of the embodiments of the present invention are set forth in the detailed description which follows; possibly inferable from the detailed description; and/or learnable by practice of the embodiments of the present invention.

BRIEF DESCRIPTION OF THE DRAWINGS

For a better understanding of embodiments of the invention and to show how the same may be carried into effect, reference will now be made, purely by way of example, to the accompanying drawings in which like numerals designate corresponding elements or sections throughout.

In the accompanying drawings.

Figure 1:
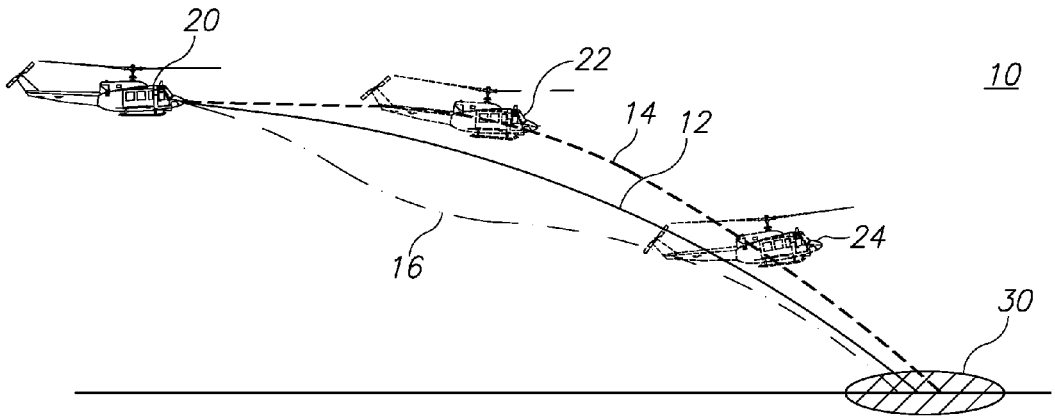
FIG. 1 is a diagram illustrating an aspect according to some embodiments of the invention.

The drawings together with the following detailed description make apparent to those skilled in the art how the invention may be embodied in practice.

DETAILED DESCRIPTION

Prior to setting forth the detailed description, it may be helpful to set forth definitions of certain terms that will be used hereinafter.

The term "aircraft" as used herein in this application refers to any air vehicle, be it a rotor propelled aircraft or a fixed-wing aircraft.

The term "flight data" as used herein in this application refers to any physical data relating to position, speed, acceleration, orientation and the like, that characterize a momentary movement of an aircraft.

The term "physical flight" as used herein in this application refers to a realistic flight pattern due to laws of physics and limitations imposed by either the performance envelope of a specified aircraft or by safety regulations.

The term "virtual wingman" as used herein in this application refers to a virtual symbol resembling another aircraft in an aircraft formation which serves as a dynamic point of reference for the pilot, in a way that resembles following a real lead plane in an aircraft formation.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Before explaining at least one embodiment of the invention in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting.

FIG. 1 is a diagram illustrating an aspect according to some embodiments of the invention. A user-selected maneuver diagram 10 shows an exemplary landing pattern of a helicopter 20. Desired flight route 12 includes the route but also desired speed and orientation in order to reach landing point 30 safely. It is understood that maneuvers other than landing are possible. In accordance with embodiments of the present invention, visual symbols 22 and 24 that may resemble helicopter 20 are presented to a pilot (not shown) flying helicopter 20. Once desired flight route 12 is determined, visual symbols 22 and 24 are positioned along it moving in a specified speed towards landing point 30 being the stationary reference point which is the object of the maneuver. Visual symbols 22 and 24, being conformal with the pilot's view and earth-space stabilized, serve as virtual wingmen resembling a real lead plane that serves as a dynamic point of reference for the rest of the pilots within the aircraft formation. It is noted that the pilot need not actually follow the route of visual symbols 22 and 24 but it is sufficient that he or she maintains a spatial relation with the visual symbols, in order to successfully carry out the user-selected maneuver.

During the maneuver, the actual flight route 16 of helicopter 20 in monitored as well as various flight data and environmental conditions. This information is used to repeatedly update the flight rote to an updated flight route 14.

Figure 2:
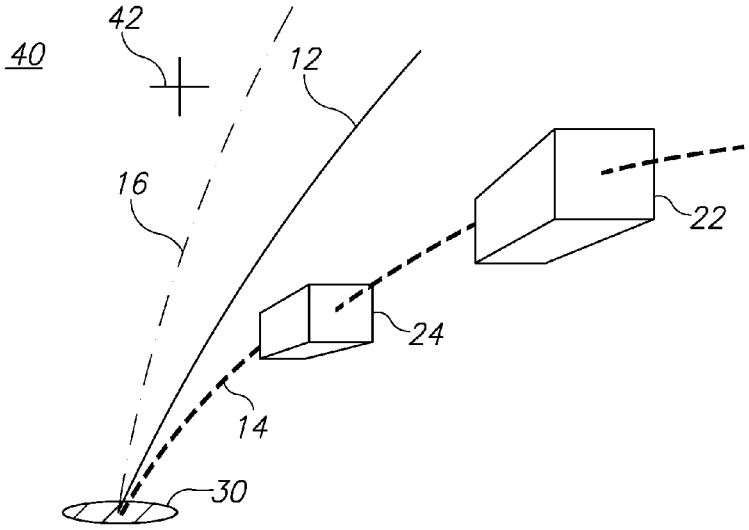
FIG. 2 is a diagram illustrating an aspect according to some embodiments of the invention.

FIG. 2 is a diagram illustrating an aspect according to some embodiments of the invention. Display view 40 schematically illustrates a perspective view of landing maneuver 10. Visual symbols 22 and 24 are shown along updated flight route 14 (with or without an actual indicator of the updated flight route itself). It is noted that actual flight route 16 and desired flight route 12 are shown here for reference only and are not part of the display. Additionally, visual symbols 22 and 24 may be shown in a manner indicative of size and orientation thus providing valuable information to the pilot by resembling an actual wingman.

According to some embodiments of the invention, the movement of visual symbols 22 and 24 complies with the limitations of a physical flight that is subject to physical and regulatory limitations. This feature further improves the resemblance to an actual wingman and improves the pilot spatial perception of the visual indicators as dynamic points of reference.

According to some embodiments of the invention, the display is embedded within a helmet (not shown) worn by the pilot. Such a helmet is provided with a mechanism for preserving line of sight so that visual symbols 22 and 24 conform to the pilot's view point that is indicated by line of sight indicator 42.

Figure 3:
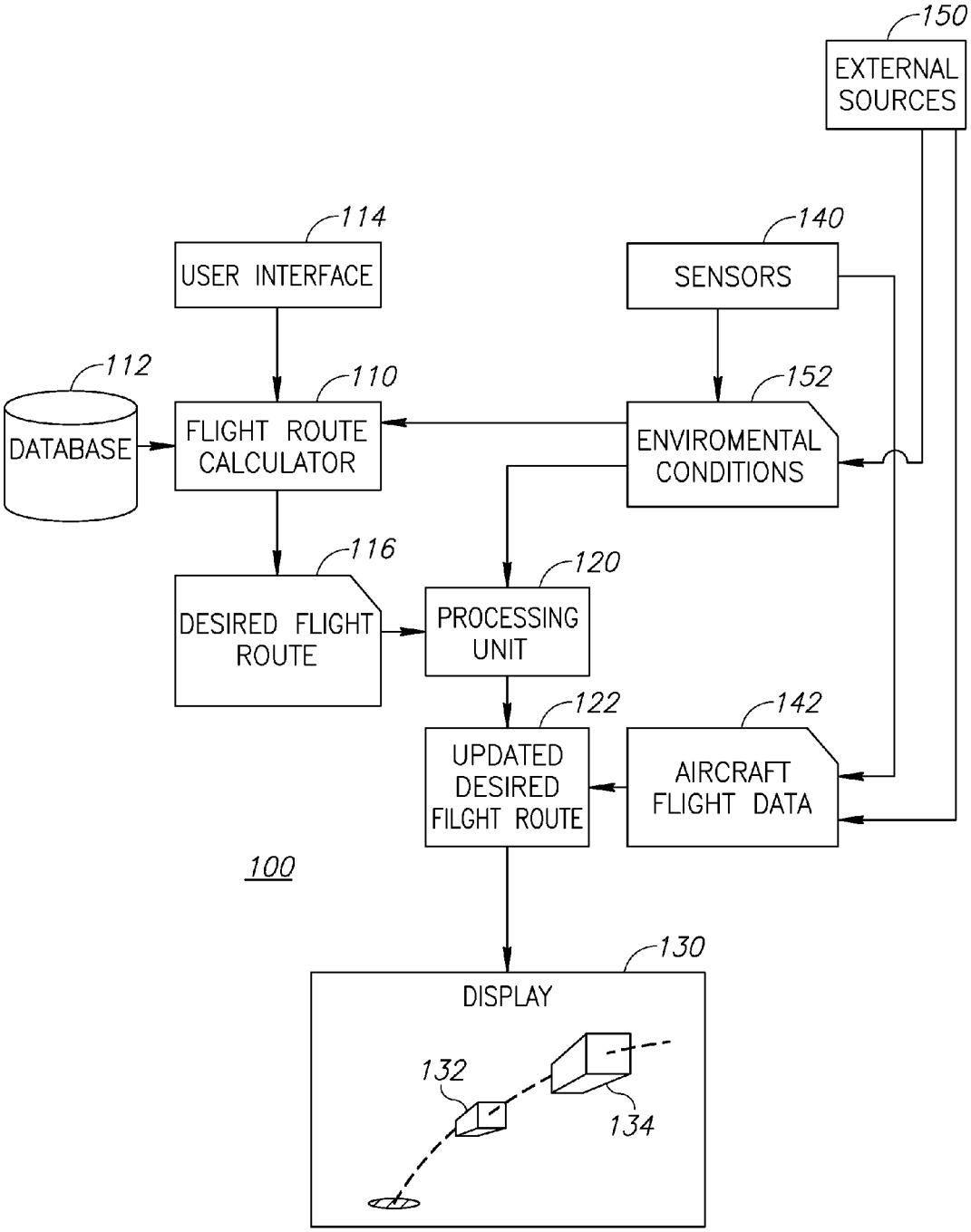
FIG. 3 is a block diagram illustrating a system according to some embodiments of the invention.

FIG. 3 is a block diagram illustrating a system according to some embodiments of the invention. System 100 includes a flight route calculator 110 configured to determine a desired flight route 116 of an aircraft (not shown), based on a user-selected maneuver possibly inputted via a user interface 114. Flight route calculator 110 may determine desired flight route 116 based on a dedicated database 112.

System 100 further includes a processing unit 120 configured, in cooperation with display 130, to present to a pilot (not shown) at least one 3D visual symbol 132, 134 each of which comply with the following conditions: (i) earth-space stabilized, and (ii) positioned along a future location on the desired route. In other words, 3D visual symbol 132, 134 are positioned on locations which the aircraft should reach within a specified period of time if it adheres with the desired flight route.

Processing unit 120 is further configured to compute an updated desired route 122 based on repeatedly updated aircraft flight data 142 obtained from various sensors 140 associated with the aircraft or from external sources 150. Aircraft flight data 142 may include location, speed, and spatial angle, of the aircraft and the like.

Consistent with some embodiments of the invention, the display is embedded within a helmet worn by the pilot, such that at least one 3D visual symbol 132 further conforms to a line of sight of the pilot. This feature is required to secure the symbol conformity with the actual view point of the pilot.

Consistent with some embodiments of the invention, processing unit 120 is further configured to compute the updated desired route further based on dynamically obtained information from either sensors 140 or external sources 150 regarding at environmental conditions 152 or obstacles along the desired route.

Consistent with some embodiments of the invention, the display is stereoscopic, providing a 3D depth sense of the at least one 3D visual symbol. This will advantageously enhance the depth perception of the 3D symbols.

Figure 4:
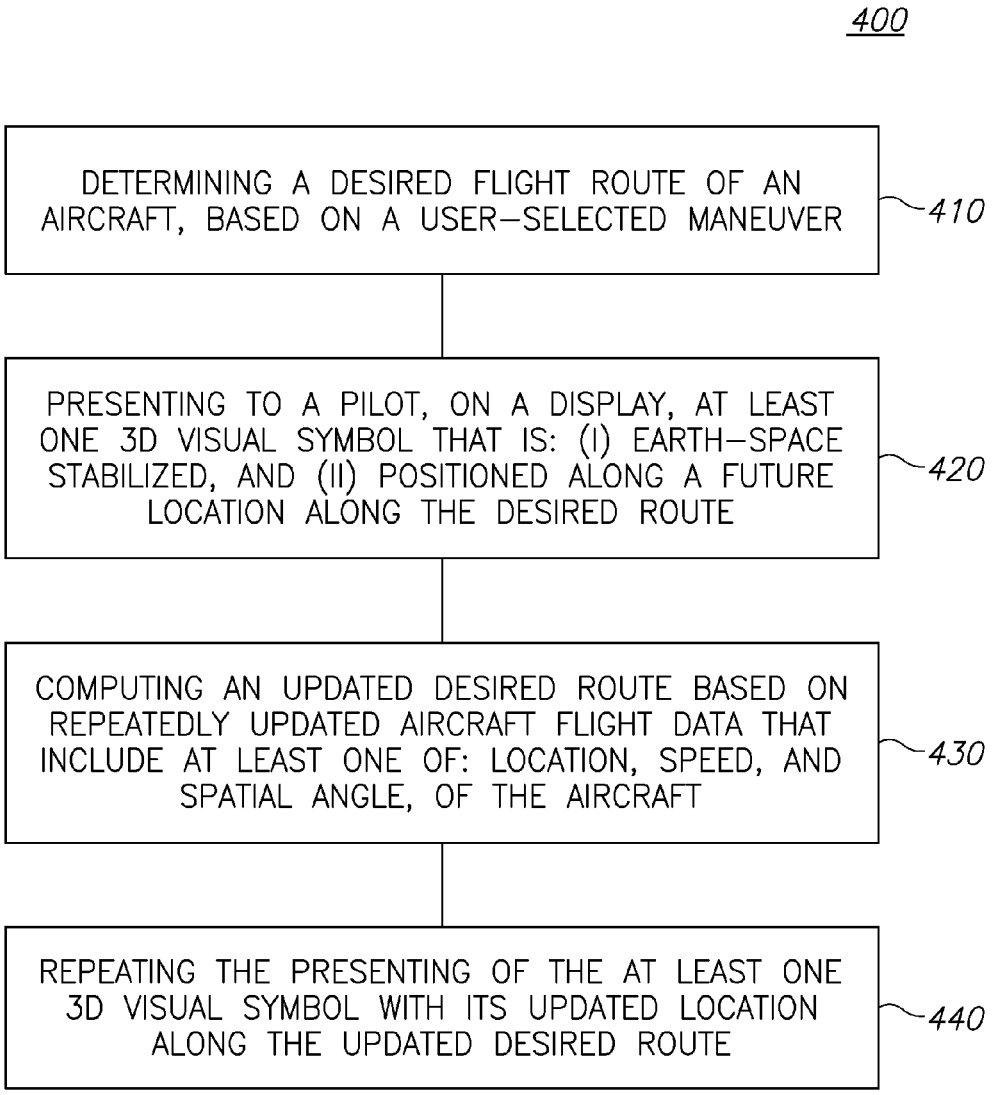
FIG. 4 is a high level flowchart illustrating a method according to some embodiments of the invention.

FIG. 4 is a high level flowchart illustrating a method a method of visually guiding a pilot flying an aircraft using one or more conformal symbols whose position is dynamically updated throughout the guidance. It is noted that method 400 may be implemented using a different architecture than of system 100. Method 400 includes the following stages: determining a desired flight route of an aircraft, based on a user-selected maneuver 410; presenting to a pilot, on a display, at least one 3D visual symbol that is: (i) earth-space stabilized, and (ii) positioned along a future location along the desired route 420; computing an updated desired route based on repeatedly updated aircraft flight data that include at least one of: location, speed, and spatial angle, of the aircraft 430; and repeating the presenting of the at least one 3D visual symbol with its updated location along the updated desired route 440.

Figure 5A:
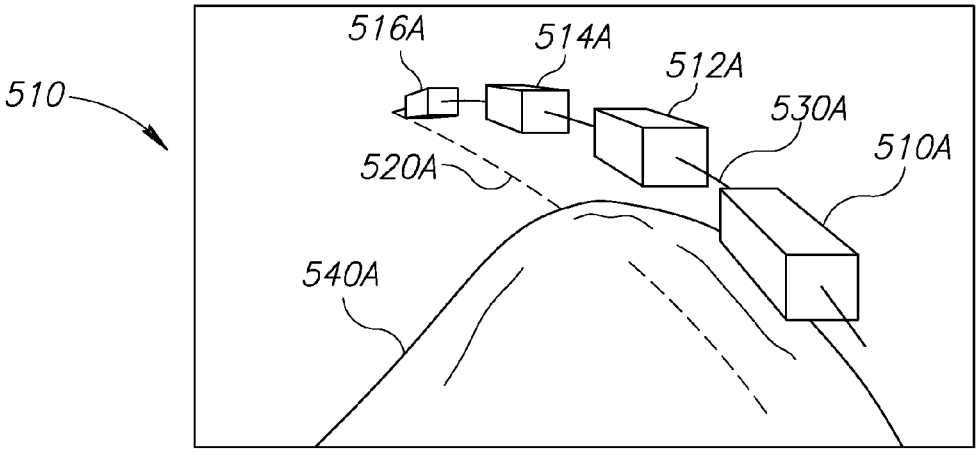
FIG. 5A is a diagram illustrating an aspect according to some embodiments of the invention.

FIG. 5 is a diagram illustrating an aspect according to some embodiments of the invention. Display 510 shows an obstacle such as a hill 540A which intersects with the desired flight route 520A. Using environmental information, the route is updated to an updated flight route 530A one or more visual symbols 510A-516A are located. According to some embodiments, several visual symbols are shown simultaneously, each on its respective position. This feature provides better visibility on future sections of the updated flight route 530A. It is noted however, that the locations of the plurality of visual symbols 510A-516A may be changed dynamically in each update of the flight route.

Similarly, when the user-selected maneuver is following a terrain in low altitude, the desired route is computed to be within a specified safety distance from the terrain. This will also affect the update of the flight route and multiple visual symbols presented simultaneously may be advantageous.

Figure 5B:
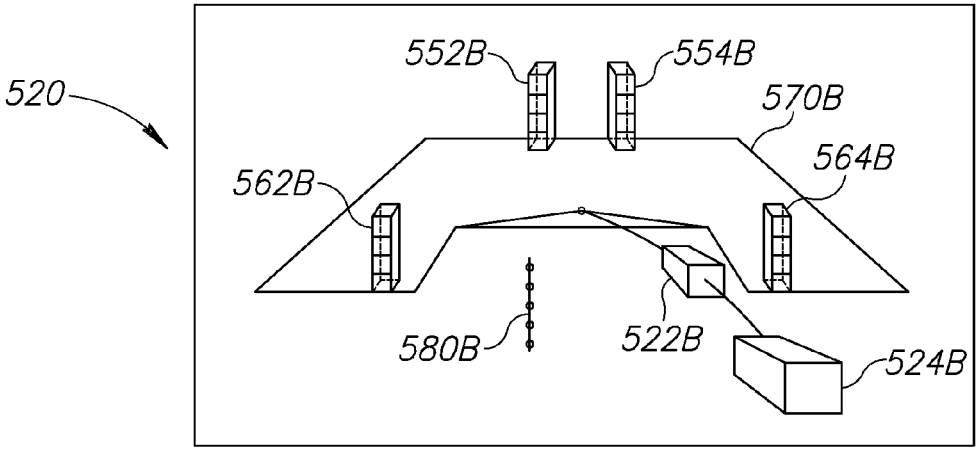
FIG. 5B is a diagram illustrating another aspect according to some embodiments of the invention.

FIG. 5B is a diagram illustrating another aspect according to some embodiments of the invention. Display 520 show a case in which the user selected maneuver is landing. On top of visual symbols 522B and 524B along updated flight route, display 520 may be further configured to present a virtual representation of a surrounding of the landing point 570B as well as stationary towers or gates 550B, 552B, 562B, and 564B. The stationary symbols may provide reference information and may also provide an indication for actual height of the aircraft, possibly using a bar (not shown).
Additionally, in order to provide the pilot with an intuitive perception of the altitude of the aircraft he or she is flying, a visual indicator 580B, possibly in a form of a vertical bar, may be further presented on the display. The presentation of visual indicator 580B is such that its height dynamically changes based on the current altitude of the aircraft. This feature is particularly advantageous in landing but may be also useful in following a terrain in low altitude.

Figure 5C:
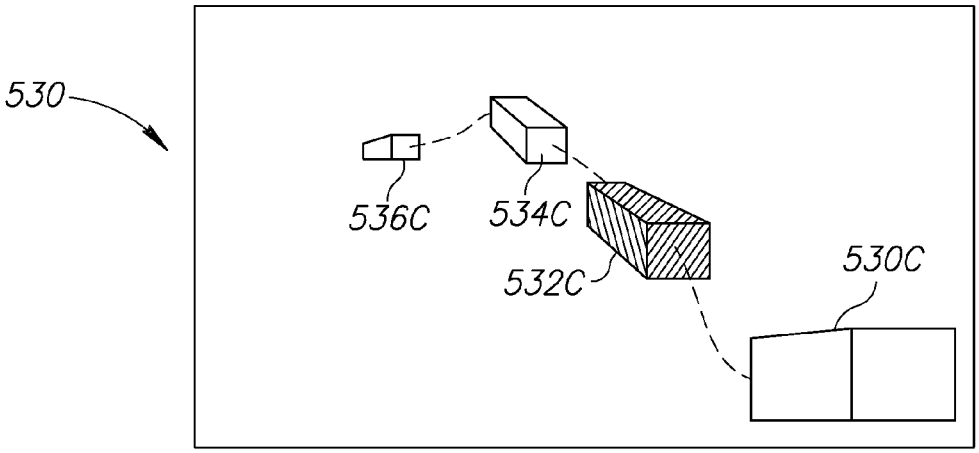
FIG. 5C is a diagram illustrating yet another aspect according to some embodiments of the invention.

FIG. 5C is a diagram illustrating yet another aspect according to some embodiments of the invention. Display 530 shows a case in which the visual symbols include a representation of their 3D orientation. For example, symbols 530C and 536C are substantially horizontal, symbol 532C is slightly inclined upwards, and symbol 534C stalls. The 3D orientation significantly improves the spatial perception of the pilot and facilitates following the desired orientation on top of the desired location and speed.

Finally, consistent with some embodiments of the invention, the visual symbol, such as 532C may change its shape or color indicative of a change in at least one of: (i) environmental conditions along the desired route; (ii) predefined phases along the desired route.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, aspects of the present invention may take the form of a computer program product embodied in one or more computer readable medium(s) having computer readable program code embodied thereon.

Reference in the specification to "some embodiments", "an embodiment", "one embodiment" or "other embodiments" means that a particular feature, structure, or characteristic described in connection with the embodiments is included in at least some embodiments, but not necessarily all embodiments, of the inventions.

It is to be understood that the phraseology and terminology employed herein is not to be construed as limiting and are for descriptive purpose only.

The principles and uses of the teachings of the present invention may be better understood with reference to the accompanying description, figures and examples.

It is to be understood that the details set forth herein do not construe a limitation to an application of the invention.

Furthermore, it is to be understood that the invention can be carried out or practiced in various ways and that the invention can be implemented in embodiments other than the ones outlined in the description above.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

While the invention has been described with respect to a limited number of embodiments, these should not be construed as limitations on the scope of the invention, but rather as exemplifications of some of the preferred embodiments. Other possible variations, modifications, and applications are also within the scope of the invention.

What is claimed is:

1. A method comprising:

determining a desired flight route of an aircraft, based on a desired maneuver;

presenting to a pilot, on a display, at least one 3D visual symbol that is positioned along a future desired location and orientation on the flight desired route and moves at a desired momentary speed and a desired orientation relative to the earth, wherein the desired momentary speed and the desired orientation are determined based on the desired maneuver;

computing an updated desired route based on repeatedly updated environmental conditions and aircraft flight data that include at least one of: current location and current speed and orientation of the aircraft; and repeating the presenting of the at least one 3D visual symbol with an updated desired position and an updated desired momentary speed and updated desired orientation, wherein movements of said 3D visual symbol resemble movements of another aircraft in an aircraft formation and wherein said 3D symbol serves as a dynamic point of reference for said pilot, resembling following a real lead aircraft in said aircraft formation.

2. The method according to claim 1, wherein the display is embedded within a helmet worn by the pilot, and wherein the at least one 3D visual symbol further conforms to a line of sight of the pilot.

3. The method according to claim 1, wherein the display is a head up display (HUD) or a head down display (HDD).

4. The method according to claim 1, wherein the at least one 3D visual symbol comprises two or more 3D symbols located with regards to the desired maneuver.

5. The method according to claim 1, wherein the at least one 3D visual symbol includes representing a 3D orientation thereof.

6. The method according to claim 1, wherein the maneuver is landing, wherein the desired route ends in a landing point.

7. The method according to claim 1, wherein the method further comprises presenting a virtual representation of a surrounding of a landing point.

8. The method according to claim 1, wherein the desired maneuver is following a terrain, wherein the desired route is computed to be within a specified safety distance from the terrain.

9. The method according to claim 1, further comprising obtaining dynamic information regarding at least one of: environmental conditions or obstacles along the desired route, wherein the computing of the updated desired route is further based on the dynamic information.

10. The method according to claim 1, wherein the presenting is carried out stereoscopically, to provide a 3D depth sense of the at least one 3D visual symbol.

11. The method according to claim 1, wherein the at least one 3D visual symbol changes its shape and/or color indicative of a change in at least one of: (i) environmental conditions along the desired route; (ii) predefined phases along the desired route; and (iii) a predefined threshold.

12. The method according to claim 1, wherein the at least one 3D visual symbol resembles a shape of an aircraft.

13. A system comprising:

a flight route calculator configured to determine a desired flight route of an aircraft, based on a desired maneuver;

a display configured to present to a pilot, on a display, at least one 3D visual symbol that is positioned in a future desired location and a desired orientation along the desired flight route and moves at a desired momentary speed and a desired orientation relative to the earth, wherein the desired momentary speed and the desired orientation are determined based on the desired maneuver; and a processing unit configured to compute an updated desired route based on repeatedly updated environmental conditions and aircraft flight data that include at least one of: current location and current speed and orientation of the aircraft, wherein the display is further configured to repeat the presenting of the at least one 3D visual symbol with an updated desired position and an updated desired momentary speed and updated desired orientation, wherein movements of said 3D visual symbol resemble movements of another aircraft in an aircraft formation and wherein said 3D symbol serves as a dynamic point of reference for said pilot, resembling following a real lead aircraft in said aircraft formation.

14. The system according to claim 13, wherein the display is embedded within a helmet worn by the pilot, and wherein the at least one 3D visual symbol further conforms to a line of sight of the pilot.

15. The system according to claim 13, wherein the display is a head up display (HUD) or a head down display (HDD).

16. The system according to claim 13, wherein the at least one 3D visual symbol comprises two or more 3D symbols located along the updated desired route.

17. The system according to claim 13, wherein the at least one 3D visual symbol includes representing a 3D orientation thereof.

18. The system according to claim 13, wherein the desired maneuver is landing, wherein the desired route ends in a landing point.

19. The system according to claim 13, wherein the display is further configured to present a virtual representation of a surrounding of a landing point.

20. The system according to claim 13, wherein the desired maneuver is following a terrain, wherein the desired route is computed to be within a specified safety distance from the terrain.

21. The system according to claim 13, further, wherein the processing unit is configured to compute the updated desired route further based on dynamically obtained information regarding at least one of: environmental conditions or obstacles along the desired route.

22. The system according to claim 13, wherein the display is stereoscopic, providing a 3D depth sense of the at least one 3D visual symbol.

23. The system according to claim 13, wherein the at least one 3D visual symbol changes its shape and/or color indicative of a change in at least one of: (i) environmental conditions along the desired route; (ii) predefined phases along the desired route; and (iii) a predefined threshold.

24. The system according to claim 13, wherein the at least one 3D visual symbol resembles a shape of an aircraft.

25. The system according to claim 13, wherein the display is further configured to present a visual indicator that changes its height dynamically, based on a current altitude of the aircraft.

* * * * *